US006958671B2

(12) United States Patent
Chen et al.

(10) Patent No.: US 6,958,671 B2
(45) Date of Patent: Oct. 25, 2005

(54) ELECTRICAL CONTACTOR WITH POSITIVE TEMPERATURE COEFFICIENT RESISTIVITY ELEMENT

(75) Inventors: William Weizhong Chen, Marion, IA (US); R. Kent Crawford, Christiana, TN (US)

(73) Assignee: Square D Company, Palatine, IL (US)

( * ) Notice: Subject to any disclaimer, the term of this patent is extended or adjusted under 35 U.S.C. 154(b) by 649 days.

(21) Appl. No.: 09/998,837

(22) Filed: Nov. 15, 2001

(65) Prior Publication Data

US 2003/0090351 A1 May 15, 2003

(Under 37 CFR 1.47)

(51) Int. Cl.[7] ..... H01H 51/22

(52) U.S. Cl. ..... 335/80; 335/132; 335/201; 361/165

(58) Field of Search ..... 361/161, 165; 335/132, 201, 126, 78–80

(56) References Cited

U.S. PATENT DOCUMENTS

| | | | | | |
|---|---|---|---|---|---|
| 3,727,157 | A | * | 4/1973 | Grunert et al. | 335/132 |
| 4,050,044 | A | * | 9/1977 | Fischer et al. | 337/137 |
| 4,431,978 | A | * | 2/1984 | Lenzing | 335/132 |
| 4,513,270 | A | * | 4/1985 | Belbel et al. | 335/195 |
| 4,594,484 | A | * | 6/1986 | Lemmer | 200/16 A |
| 4,757,420 | A | * | 7/1988 | Saletta et al. | 361/187 |
| 5,495,083 | A | * | 2/1996 | Aymami-Pala et al. | 218/1 |
| 5,502,609 | A | | 3/1996 | Thomas et al. | 361/6 |
| 5,530,613 | A | | 6/1996 | Bauer et al. | 361/58 |
| 5,629,658 | A | | 5/1997 | Chen | 335/201 |
| 5,644,283 | A | * | 7/1997 | Grosse-Wilde et al. | 338/20 |
| 5,777,286 | A | * | 7/1998 | Abot et al. | 218/36 |
| 5,867,356 | A | | 2/1999 | Duggal et al. | 361/13 |
| 2001/0021090 | A1 | * | 9/2001 | Bernard et al. | 361/9 |

FOREIGN PATENT DOCUMENTS

| | | |
|---|---|---|
| JP | 0867895 A2 | 9/1998 |
| WO | WO99/14776 | 3/1999 |

* cited by examiner

*Primary Examiner*—Michael Friedhaffer
*Assistant Examiner*—Bernard Rojas
(74) *Attorney, Agent, or Firm*—Larry I. Golden

(57) ABSTRACT

The present invention provides an electrical contactor for connecting and disconnecting an electrical power source to an electrical device wherein the electrical power source is electrically connected to a line terminal having a line terminal electrical contact and the electrical device is electrically connected to a load terminal electrical contact. The electrical contactor contains a plurality of electrical contacts which contact the line and load terminal electrical contacts. A positive temperature coefficient resistivity element is electrically connected between at least one of the terminals and the electrical contactor contacts to provide arc suppression during the opening and closing of the electrical contacts

11 Claims, 2 Drawing Sheets

ELECTRICAL CONTACTOR WITH POSITIVE TEMPERATURE COEFFICIENT RESISTIVITY ELEMENT

BACKGROUND OF THE INVENTION

1. Field of the Invention

The present invention relates generally to an apparatus with a plurality of contacts for connecting and disconnecting an electrical power source to an electrical device while suppressing transient energy between the plurality of contacts and more particularly to an electrical contactor electrically coupled to a positive temperature coefficient resistivity (PTC) element for reducing arcing between the electrical contactor's contacts.

2. Description of the Related Art

FIGS. 1(*a*) and 1(*b*) illustrate a prior art electrical contactor 10, which is commonly used as a control device for various types of motors. The contactor 10 has a yoke 12, comprising a ferromagnetic material, and at least one coil 14, which is positioned in at least one opening in yoke 12. An armature 16, also comprising a ferromagnetic material, is positioned atop yoke 12 and can be manipulated by at least one coil 14, as discussed below.

Two pairs of contacts 18, 20 and 22, 24 are typically used in electrical contactor 10. Contacts 18, 22 are stationary, with contact 18 mounted on line terminal 26 and contact 22 mounted on load terminal 28. Contacts 20, 24 are mounted on blade 30, which moves in tandem with armature 16. Armature 16 and blade 30 are affixed to a shaft or carrier 32, having a distal end and a proximal end, and comprising a nonconductive material, for example, a thermoplastic. Carrier 32 may contain a recess for receipt of a compression spring 34, which is used to ensure contact between contacts 18, 20, 22 and 24. The electrical contactor 10 contains additional components which are well known in the art and, therefore, these components have not been discussed for the sake of simplicity.

FIG. 1(*a*) illustrates an electrical contactor 10 in an "open" or non-conducting position. In the open position, no current flows though coil 14. Subsequently, there is no electromagnetic force interacting with armature 16.

As current flows through coil 14, an electromagnetic force is generated which attracts armature 16. Armature 16 is pulled toward yoke 12 and coil 14 by the electromagnetic force, which causes carrier 32 and blade 30 to move toward yoke 12 and coil 14. As the armature 16, carrier 32 and blade 30 move toward the yoke 12 and coil 14, moveable contact 20 contacts stationary contact 18 and moveable contact 24 contacts stationary contact 22, as illustrated in FIG. 1(*b*). Contact between the two pairs of contacts 18, 20, 22 and 24 is substantially simultaneous. As discussed above, compression spring 34 places a sufficient force on carrier 32 to ensure that moveable contacts 20, 24 contact stationary contacts 18, 22, respectively, when current flows though coil 14.

Upon termination or interruption of current flow in coil 14 and removal of the electromagnetic force, armature 16, carrier 32 and blade 30 move away from yoke 12 and coil 14 and moveable contacts 20, 24 separate from stationary contacts 18, 22, respectively, as illustrated in FIG. 1(*a*).

There are several disadvantages with use of the prior art electrical contactor 10. Arching may occur when contacts 18, 20, 22 and 24 close and separate, thereby gradually eroding away the contacts. Severe arc erosion commonly occurs during motor startup or interruption of a locked motor. Typically, existing electrical contactors are limited to a maximum of approximately 9,000 operation cycles under such severe conditions because the electrical contactors have to make or interrupt approximately 6 times the contactor's continuous current rating.

Another disadvantage of the prior art is contact welding. With the existence of high currents during startup of a motor or interruption of a locked motor, contacts 18, 20, 22 and 24 are prone to become welded together resulting in a permanent closed circuit. Welding of the contacts 18, 20, 22 and 24 may lead an operator to abuse the on/off mechanism and/or contactor case, further damaging the device in an attempt to force open the contacts of the electrical contactor 10. Additionally, the welds may be broken by operation of the contactor following a welding of the contacts. In this case, severe pitting may exist in the vicinity of the broken weld. This may lead to improper contact engagement during future operations resulting in a high resistance contact, which may further lead to decreased contact life, additional welding or a runaway thermal condition. Clearly, once contact welding occurs, the electrical contactor will fail to function properly.

In an attempt to reduce the possibility of arc welding of the contacts, silver/cadmium oxide contacts are commonly used. Cadmium is a harmful element to human beings and the United States Environmental Protection Agency (EPA) has expressed concern about the use of silver/cadmium oxide contacts. Therefore, an alternative to the use of silver/cadmium oxide contacts is desirable.

Thus there is a need for a simple electrical contactor which overcomes the foregoing disadvantages of the prior art by providing a positive temperature coefficient resistivity element electrically coupled or connected to a plurality of contacts in the electrical contactor to suppress transient energy between the contacts.

SUMMARY OF THE INVENTION

A preferred embodiment of the present invention features an electrical contactor for connecting and disconnecting an electrical power source to an electrical device wherein the electrical power source is electrically connected to a line terminal having a line terminal electrical contact and the electrical device is electrically connected to a load terminal electrical contact.

In the preferred embodiment, an electromagnetic element is electrically coupled to the electrical power source for generation of a magnetic field. Upon generation of the magnetic field, a slidable carrier, having an armature affixed to a distal end and an asymmetrical blade affixed to a proximal end is attracted to the electromagnetic element. The blade has a plurality of electrical contacts wherein one electrical contact is aligned with the line terminal contact and a second electrical contact is aligned with the load terminal contact. The contacts electrically connect the electrical power source to the electrical device upon generation of the magnetic field and disconnect the power source from the electrical device upon removal of the magnetic field. A positive temperature coefficient resistivity element is electrically coupled to the blade and the load terminal for providing arc suppression during the opening and closing of the electrical contacts.

In an alternative embodiment, the electrical contacts on the blade, which is symmetrical, are aligned with a stationary electrical contact and the load terminal electrical contact. The line terminal is physically and electrically separate from the stationary electrical contact. However, a connector electrically connects the line terminal to the blade. The electrical contacts electrically connect the electrical power source to the electrical device upon generation of a magnetic field and electrically disconnect the electrical power source to the electrical device upon removal of the magnetic field. The positive temperature coefficient resistivity element is electrically coupled to the stationary electrical contact and the load terminal electrical contact for providing arc suppression during the opening and closing of the electrical contacts.

In yet another embodiment, a spring strap having an electrical contact replaces the stationary electrical contact. The spring strap propels an electrical contact, affixed to it, upwardly thereby providing sequential contact between the contacts with the spring strap electrical contact and a blade electrical contact closing prior to the load terminal electrical contact and the second blade electrical contact. The positive temperature coefficient resistivity element is electrically coupled to the spring strap electrical contact and the load terminal electrical contact for providing arc suppression during the opening and closing of the contacts.

Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DETAILED DESCRIPTION OF THE PREFERRED EMBODIMENT

The present invention relates to an electrical contactor having a positive temperature coefficient resistivity (PTC) element for suppressing transient energy, typically arcing. The PTC element can comprise a pure metallic material, such as pure tungsten or pure iron, a conductive polymer or ceramic PTC material. The PTC element suppresses any arc that may occur between the electrical contacts of the contactor. A certain amount of the interruption energy is converted into heat energy in the PTC element. As a result of the reduction of contact arcing, the erosion of the electrical contacts is dramatically reduced and contact welding is eliminated. Therefore, the present invention increases the life and continuous current rating of the electrical contactor.

Figure 2:
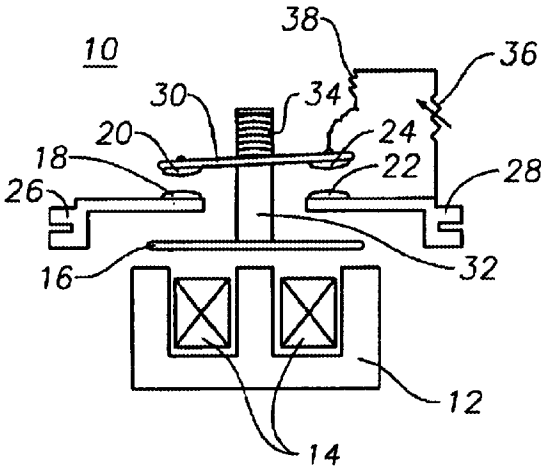
FIG. 2 illustrates an electrical contactor having an asymmetrical blade for sequential opening and closing of contacts and a PTC element used in the suppression of transient energy between contacts of the electrical contactor in accordance with a preferred form of the present invention.

FIG. 2 illustrates a preferred embodiment of the present invention wherein a PTC element 36 is electrically connected in parallel with contacts 22, 24. A flexible conductor 38 may be affixed to blade 30 and used to connect PTC element 36 to electrical contactor 10 or PTC element 36 may be wired directly to blade 30 and load terminal 28. Blade 30 is asymmetrical to ensure a sequential connection/separation of the two sets of contacts 18, 20 and 22, 24. Both sets of contacts 18, 20 and 22, 24 are connected in series, carry current under normal operating conditions and contribute to the total contact resistance. Contact resistance is a major cause of thermal increase in electrical contactor 10 at full continuous current rating. Therefore, the higher the contact resistance, the lower the continuous current rating and vice versa.

As current flows through coil 14, an electromagnetic force is created which attracts armature 16. Armature 16 is pulled toward yoke 12 and coil 14 by the electromagnetic force, which also causes carrier 32 and blade 30 to move toward yoke 12 and coil 14. As the armature 16, carrier 32 and blade 30 move toward the yoke 12 and coil 14, moveable contact 20 contacts stationary contact 18 and moveable contact 24 contacts stationary contact 22.

Figure 1B:
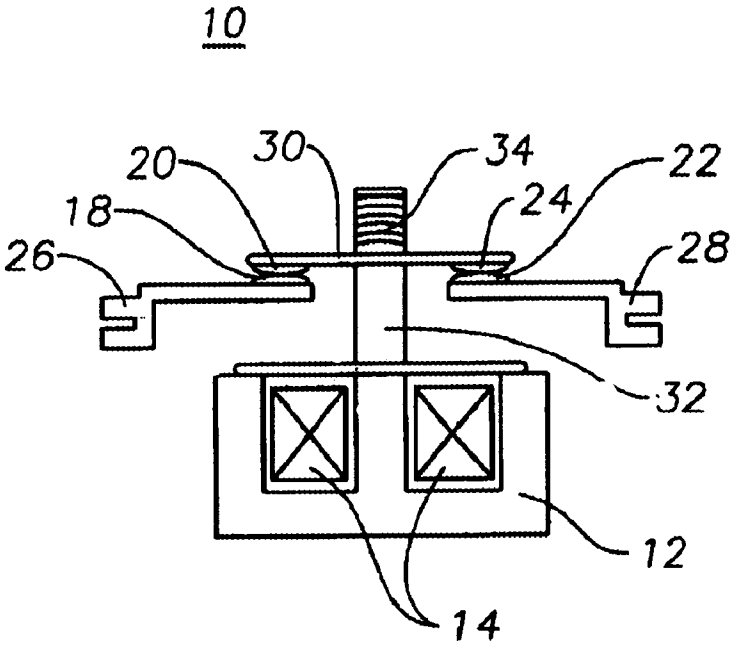
Fig. 1B (Prior Art)
FIG. 1*b* illustrates the prior art electrical contactor of FIG. 1*a* with contacts in a "closed" or contact position.
Figure 1A:
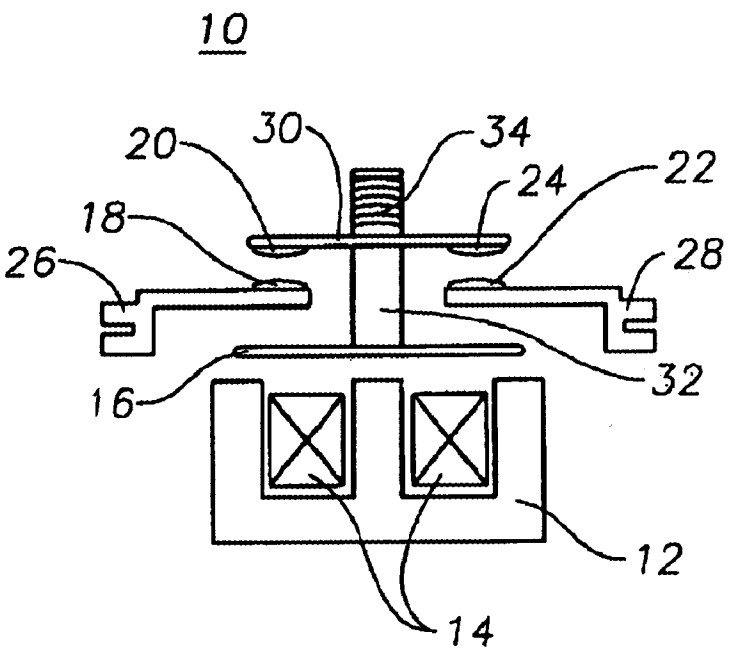
Fig. 1A (Prior Art)
FIG. 1*a* illustrates a prior art electrical contactor with contacts in an "open" or non-contact position.

Contacts 18, 20 make contact before contacts 22, 24 as a result of the asymmetrical blade 30. When contact is made between contacts 18, 20 electrical current flows though contacts 18, 20 the PTC element 36. There is less arcing between contacts 18, 20 compared to the prior art electrical connector 10 in FIG. 1, because the PTC element 36 limits current flow during the closing of contacts 18, 20. Any arc between contacts 22, 24 is also suppressed during the connection of the contacts because of the parallel PTC element 36.

When the electrical contactor 10 is utilized to interrupt current, current is removed from coil 14, thereby removing the electromagnetic field, and armature 16 is release from the coil 14 and yoke 12. Contacts 22, 24 open prior to contacts 18, 20 because of the asymmetrical shape of blade 30. Once contacts 22, 24 are opened, current is shunted to the PTC element 36 and any arc between contacts 22, 24 is suppressed. As a current limiting device, the PTC element 36 also suppresses the arc between contacts 18, 20 following the separation of contacts 22, 24.

Figure 3:
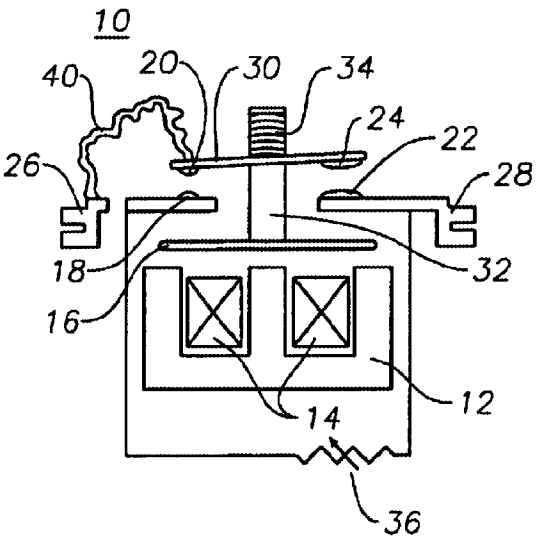
FIG. 3 illustrates an alternative embodiment of the present invention wherein a stationary electrical contact is employed in the sequential opening and closing of the contacts and a PTC element is used in the suppression of transient energy between contacts of the electrical contactor.

FIG. 3 illustrates an alternative embodiment of the present invention. A connector 40, preferably a thick braid connector, is connected in parallel with contacts 18, 20 and in series with contacts 22, 24. Line terminal 26 is physically and electrically separate from stationary contact 18. PTC element 36 is connected in parallel with contacts 22, 24 and in series with contacts 18, 20. Under normal operating conditions when contacts 18, 20, 22 and 24 are closed, a substantial portion of current flows through connector 40 and contacts 22, 24. Very little current flows through contacts 18, 20 since the resistance of the PTC element 36 is substantially larger than the contact resistance of either set of contacts. The total contact resistance of the electrical contactor 10 illustrated in FIG. 3 is approximately half the total resistance of the electrical contactor in FIG. 2. Therefore, the continuous current rating of the electrical contactor 10 in FIG. 3 is higher than that of the electrical contactor 10 in FIG. 2. Additionally, contacts 18, 20 in electrical contactor 10 in FIG. 3 can be made smaller and from inexpensive material since the contacts 18, 20 do not have to continuously carry current.

The arc suppression effectiveness of the electrical contactor 10 in FIG. 3 is equivalent to the arc suppression effectiveness of the electrical contactor 10 in FIG. 2. When the electrical contactor 10 in FIG. 3 opens, contacts 22, 24 open first because of the asymmetrical blade 30. Since the current is shunted to pass through the PTC element 36 and contacts 18, 20, the arc between contacts 22, 24 is suppressed. Contacts 18, 20 open after the PTC element 36 provides current limitation. As a result of the current limitation of PTC element 36, any arc between contacts 18, 20 is also suppressed and the current is interrupted after the arc is extinguished between contacts 18, 20.

When power is to be applied from the electrical power source to the electrical device, blade 30 is moved by the attraction of the armature 16 to the yoke 12 and coil 14. In the sequential closing process, contacts 18, 20 close first followed by closure of contacts 22, 24. In this manner, any arc between the contacts is suppressed due to PTC element 36.

As can be seen above, by adding PTC element 36 to the electrical contactor 10 circuit, any arc between contacts 18, 20, 22 and 24 is effectively suppressed. There is no need to use silver/cadmium oxide contacts in electrical contactor 10. Silver/tin oxide or silver/nickel contacts can be used with the present invention. The silver percentage at the contact surface can be increased with the present invention. The silver content makes the electrical contacts 18, 20, 22 and 24 soft and thus reduces the contact resistance. This helps to increase the continuous current rating of the electrical contactor.

Figure 4:
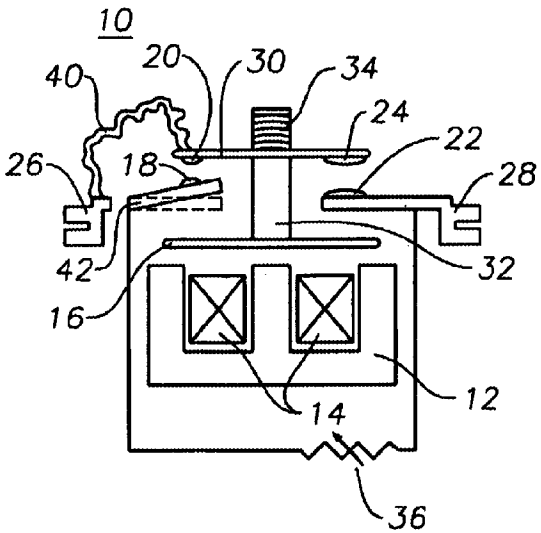
FIG. 4 illustrates an alternative embodiment of the present invention wherein a symmetrical blade and spring strap, having an electrical contact, allow for sequential opening and closing of the contacts and a PTC element is used in the suppression of transient energy between contacts of the electrical contactor.

FIG. 4 illustrates an alternative embodiment which allows for sequential opening and closing of electrical contacts 18, 20, 22 and 24 with the use of a symmetrical blade 30. The electrical contactor 10 in FIG. 4 uses an electrical contact 18 mounted on a spring strap 42, which asserts an upward force on electrical contact 18 during the opening of electrical contacts 18, 20. The spring strap 42 places electrical contact 18 in close proximity to electrical contact 20. Therefore, electrical contacts 18, 20 open subsequent to the opening of electrical contacts 22, 24. During the closing of the electrical contacts 18, 20, 22 and 24, electrical contacts 18, 20 close prior to closure of electrical contacts 22, 24 and spring strap 42 is lowered to a bottom position after electrical contacts 18, 20, 22 and 24 are closed.

The foregoing description is directed to particular embodiments of the present invention for the purpose of illustration and explanation. It will be apparent, however, to one skilled in the art that many modifications and changes to the embodiment set forth are possible without departing from the scope and the spirit of the invention. It is intended that the following claims be interpreted to embrace all such modifications and changes.

What is claimed is:

1. An electrical contactor for connecting and disconnecting an electrical power source to an electrical device, wherein the electrical power source is electrically connected to a line terminal and the electrical device is electrically connected to a load terminal having an electrical contact, comprising:

(a) an electromagnetic element electrically coupled to the electrical power source for generation of a magnetic field;

(b) a slidable carrier having a distal end and a proximal end;

(c) an armature affixed to said distal end of said slidable carrier, said armature attracted to said electromagnetic element upon generation of said magnetic field;

(d) a blade affixed to said proximal end of said slidable carrier, said blade having a first electrical contact aligned with a stationary electrical contact and a second electrical contact aligned with the load terminal electrical contact, said first and second electrical contacts electrically connecting the electrical power source to the electrical device upon generation of said magnetic field and electrically disconnecting the electrical power source to the electrical device upon removal of said magnetic field, the blade further being asymmetrical to provide sequential contact and separation between said first electrical contact and said stationary electrical contact and said second electrical contact and the load terminal electrical contact; and (e) a positive temperature coefficient resistivity element electrically coupled to said stationary electrical contact and said load terminal electrical contact for providing arc suppression during the opening and closing of said first and second electrical contacts and said stationary electrical contact and the load terminal electrical contact.

2. The electrical contactor of claim 1 wherein said slidable carrier further comprises an aperture for insertion of a compression spring to ensure contact between said first and second electrical contacts and said stationary electrical contact and the load terminal electrical contact upon generation of said magnetic field in said electromagnetic element.

3. The electrical contactor of claim 1 wherein said positive temperature coefficient resistivity element comprises a pure metallic material.

4. The electrical contactor of claim 1 wherein said positive temperature coefficient resistivity element comprises a conductive polymer.

5. The electrical contactor of claim 1 wherein said positive temperature coefficient resistivity element comprises a ceramic material.

6. An electrical contactor for connecting and disconnecting an electrical power source to an electrical device, wherein the electrical power source is electrically connected to a line terminal and the electrical device is electrically connected to a load terminal having an electrical contact, comprising:

(a) a load terminal having a load terminal electrical contact;

(b) a line terminal having a line terminal electrical contact;

(c) a blade member having first electrical contact thereupon for contacting the load terminal contact and a second electrical contact thereupon for contacting the line terminal electrical contact, the blade member being moveable and further being asymmetrical to provide sequential contact and separation between said first electrical contact and said line electrical contact and said second electrical contact and the load terminal electrical contact; and (d) a positive temperature coefficient resistivity element electrically coupled to said blade for providing arc suppression during the opening and closing of said electrical contacts.

7. The electrical contactor of claim 6 further comprising a slidable carrier for movement of the blade, the slidable carrier having a distal end and a proximal end, the blade being affixed to the proximal end of the slidable carrier.

8. The electrical contactor of claim 7 further comprising:

an armature affixed to the distal end of the slidable carrier, the armature being magnetically attractive to a magnetic source;

an magnetic element for attraction of the armature toward the magnetic element; and a spring to resist attraction of the armature toward the magnetic element.

9. The electrical contactor of claim 6 wherein the positive temperature coefficient resistivity element comprises a pure metallic material.

10. The electrical contactor of claim 6 wherein the positive temperature coefficient resistivity element comprises a conductive polymer.

11. The electrical contactor of claim 6 wherein the positive temperature coefficient resistivity element comprises a ceramic material.

* * * * *